US011731795B2

(12) United States Patent
Kurosaki

(10) Patent No.: US 11,731,795 B2
(45) Date of Patent: Aug. 22, 2023

(54) METHOD AND APPARATUS FOR MANUFACTURING PILLOW PACKAGES

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 0 days.

(21) Appl. No.: 17/763,426

(22) PCT Filed: Apr. 15, 2020

(86) PCT No.: PCT/JP2020/016594

§ 371 (c)(1),
(2) Date: Mar. 24, 2022

(87) PCT Pub. No.: WO2021/210102

PCT Pub. Date: Oct. 21, 2021

(65) Prior Publication Data

US 2022/0340319 A1 Oct. 27, 2022

(51) Int. Cl.
*B65B 35/58* (2006.01)
*B65B 9/06* (2012.01)
(Continued)

(52) U.S. Cl.
CPC ..... *B65B 35/58* (2013.01); *B65B 9/06* (2013.01); *B65B 25/145* (2013.01); *B65B 35/40* (2013.01);
(Continued)

(58) Field of Classification Search
CPC ..... B65B 9/06; B65B 25/145; B65B 35/40; B65B 35/44; B65B 35/56; B65B 35/58;
(Continued)

(56) References Cited

U.S. PATENT DOCUMENTS 2,319,103 A * 5/1943 Allen ..... B65B 61/06 83/578
4,130,480 A * 12/1978 Loewenthal ..... B65B 61/28 209/644
(Continued)

FOREIGN PATENT DOCUMENTS

CN 1172753 A 2/1998
CN 1368459 A 9/2002
(Continued)

OTHER PUBLICATIONS

International Search Report for PCT/JP2020/016594 dated Aug. 4, 2020 [PCT/ISA/210].

*Primary Examiner* — Stephen F. Gerrity
(74) *Attorney, Agent, or Firm* — Sughrue Mion, PLLC

(57) ABSTRACT

To provide a method and an apparatus for manufacturing pillow packages provided with a fixing tape with high efficiency while preventing damage to the pillow packages. The method for manufacturing pillow packages includes placing a pillow package 1*a* among a plurality of pillow packages conveyed by a conveying section 21 on an inclined placement section of the conveying section 21 to incline the pillow package 1*a* in a predetermined direction to thereby expand the gap between a pillow package 1*b* placed next to the pillow package 1*a* on the conveying section 21 and the pillow package 1*a* and bringing a cutting blade 25 into contact with a string of double-sided tape 16 bonded between the pillow package 1*a* and the pillow package 1*b* to cut the double-sided tape 16.

5 Claims, 7 Drawing Sheets

(51) Int. Cl.

| | |
|---|---|
| ***B65B 25/14*** | (2006.01) |
| ***B65B 35/40*** | (2006.01) |
| ***B65B 61/06*** | (2006.01) |
| ***B65B 65/00*** | (2006.01) |

(52) U.S. Cl.
CPC ..... *B65B 61/06* (2013.01); *B65B 65/003* (2013.01); *B65B 2220/06* (2013.01)

(58) Field of Classification Search
CPC ..... B65B 43/123; B65B 51/06; B65B 61/06; B65B 61/28; B65B 65/003; B65B 2220/06; B65B 2220/22
See application file for complete search history.

(56) References Cited

U.S. PATENT DOCUMENTS

| | | | | | |
|---|---|---|---|---|---|
| 4,570,418 | A * | 2/1986 | Gino | B65B 61/06 | 53/244 |
| 6,789,375 | B2 * | 9/2004 | Honegger | B65B 9/06 | 53/450 |
| 2002/0104292 | A1 | 8/2002 | Tsuruta | | |
| 2005/0039845 | A1 * | 2/2005 | Belt | B65B 51/06 | 156/196 |
| 2005/0069230 | A1 | 3/2005 | Takahashi et al. | | |
| 2009/0260324 | A1 | 10/2009 | Funaki et al. | | |
| 2017/0057671 | A1 * | 3/2017 | van Wandelen et al. | B65B 61/06 | |

FOREIGN PATENT DOCUMENTS

| | | | | | |
|---|---|---|---|---|---|
| CN | 1592701 | A | | 3/2005 | |
| CN | 1657365 | A | | 8/2005 | |
| CN | 101035717 | A | | 9/2007 | |
| DE | 4120480 | A1 | * | 12/1992 | B65B 17/02 |
| DE | 102010046561 | A1 | * | 3/2012 | B65B 25/145 |
| JP | 3028020 | U | | 8/1996 | |
| JP | 10-059306 | A | | 3/1998 | |
| JP | H11314663 | A | * | 11/1999 | |
| JP | 2001348055 | A | * | 12/2001 | |
| JP | 2002-234572 | A | | 8/2002 | |
| JP | 3140938 | U | | 4/2008 | |
| JP | 2015054722 | A | * | 3/2015 | B65B 17/02 |
| JP | 2020-023357 | A | | 2/2020 | |

* cited by examiner

METHOD AND APPARATUS FOR MANUFACTURING PILLOW PACKAGES

CROSS REFERENCE TO RELATED APPLICATIONS

This application is a National Stage of International Application No. PCT/JP2020/016594 filed Apr. 15, 2020.

TECHNICAL FIELD

The present disclosure relates to a method and an apparatus for manufacturing pillow packages in which tissue paper, folded toilet paper, or the like is wrapped with a thin resin sheet.

BACKGROUND ART

Some products that are bundles of a plurality sheets of thin paper, such as toilet paper and tissue paper, are piled are subjected to pillow packaging using a thin resin sheet to reduce the weight in transportation and mass-production cost.

Pillow packages can be reduced in weight, as described above, and can be fixed to a vertical wall surface using a double-sided tape or the like.

Some pillow packages that contain toilet paper or tissue paper are provided with a fixing tape or the like so as to be fixed where the toilet paper or tissue paper is used.

Specific examples include a pocket tissue which is a bundle of multiple sheets of folded thin paper subjected to pillow packaging and in which a double-sided tape is bonded to the opposite side of a tissue paper outlet and a pocket tissue to which an acrylic adhesive that can be pasted and peeled repeatedly is applied (for example, PTL 1).

Another example is a folded toilet tissue wrapped by vinyl or the like and provided with a double-sided tape or the like on the opposite side from a toilet tissue outlet opening so as to be bonded to, for example, the upper part of a toilet paper roll holder (for example, PTL 2).

CITATION LIST

Patent Literature

PTL 1: Japanese Registered Utility Model No. 3028020
PTL 2: Japanese Registered Utility Model No. 3140938

SUMMARY OF INVENTION

Technical Problem

Pillow packages are easily damaged, for example, torn, when a sharp blade or the like comes into contact therewith, because they are made of a thin resin sheet.

In the case where of providing an adhesive member, such as a double-sided tape, on pillow packages, individual pillow packages are fixed at position, and a double-sided tape that is cut in a predetermined length at a position away from the pillow package is bonded to the pillow package.

For this reason, mass-production of pillow packages provided with a double-sided tape or the like has a problem in that a substantial amount of time is required and the production efficiency is decreased.

The present disclosure is made in view of the above problem and provides a method and an apparatus for manufacturing pillow packages provided with fixing tape, with high production efficiency by preventing damage to the pillow packages.

Solution to Problem

A method for manufacturing pillow packages according to the present disclosure includes a first process for wrapping a thin paper bundle of a plurality of sheets of thin paper with a resin sheet and sealing a predetermined portion of the resin sheet to form a sealed portion, a second process for placing the pillow packages having the sealed portion on a conveying means, a third process for changing orientation of the plurality of the pillow packages conveyed by the conveying means to predetermined placement orientation, a fourth process for bonding a string of double-sided tape to predetermined surfaces of the plurality of pillow packages disposed upside at the predetermined placement orientation, a fifth process for cutting the string of double-sided tape bonded to the plurality of pillow packages between the plurality of pillow packages, wherein the fifth process places one pillow package of the plurality of pillow packages conveyed by the conveying means on an inclined placement section provided at the conveying means to incline the pillow package in a predetermined direction, a sixth process for expanding a space between another pillow package next to the one pillow package and the one pillow package, and a seventh process for bringing a cutting blade into contact with the string of double-sided tape bonded between the one pillow package and the other pillow package to cut the double-sided tape.

The third process includes arranging the plurality of pillow packages in two rows along a width direction orthogonal to a conveying direction of the conveying means. The fourth process includes bonding the string of double-sided tape to the plurality of pillow packages arranged in two rows. The sixth process includes placing the one pillow package aligned with the other pillow package in the width direction on the inclined placement section.

The third process includes arranging the plurality of pillow packages in two rows along a width direction orthogonal to a conveying direction of the conveying means. The fourth process includes bonding the string of double-sided tape to the plurality of pillow packages arranged in two rows. The sixth process includes, wherein the inclined placement section includes a first inclined placement section and a second inclined placement section each having an inclined surface inclined in a different direction, placing the one pillow package arranged in the width direction together with the other pillow package on the inclined surface of the first inclined placement section to incline the one pillow package in one direction and placing the other pillow package on the inclined surface of the second inclined placement section to incline the other pillow package in another direction.

The third process includes arranging the plurality of pillow packages in such a manner that surfaces not including the sealed portion face each other. The fourth process includes bonding the string of double-sided tape to the plurality of pillow packages arranged in such a manner that the surfaces not including the sealed portion face each other in the conveying direction. The sixth process includes placing the one pillow package to which the string of double-sided tape is bonded and located at a head when conveyed by the conveying means on the inclined placement section.

An apparatus for manufacturing pillow packages according to the present disclosure includes a conveying section that conveys pillow packages in which a thin paper bundle is wrapped with a resin sheet, a placement changing section that changes orientation of the pillow packages placed on the conveying section to predetermined placement orientation, a tape bonding section that bonds a string of double-sided tape to predetermined surfaces of the plurality of pillow packages, the surfaces being disposed upside at the predetermined placement orientation, and a tape cutting section that cuts the string of double-sided tape bonded to the plurality of pillow packages between the plurality of pillow packages. The conveying section includes an inclined placement section that, when one pillow package of the plurality of pillow packages conveyed is placed, inclines the one pillow package in a predetermined direction to expand a gap between the one pillow package and another adjacent pillow package at the installation position of the tape cutting section. The tape cutting section includes a cutting blade that is brought into contact with the string of double-sided tape bonded between the one pillow package and the other pillow package placed on the inclined placement section.

Advantageous Effects of Invention

The present disclosure allows fixing tape to be efficiently bonded to a plurality of pillow packages to reduce the manufacturing time.

DESCRIPTION OF EMBODIMENTS

Embodiments of the present invention will be described hereinbelow.

First Embodiment

Figure 1:
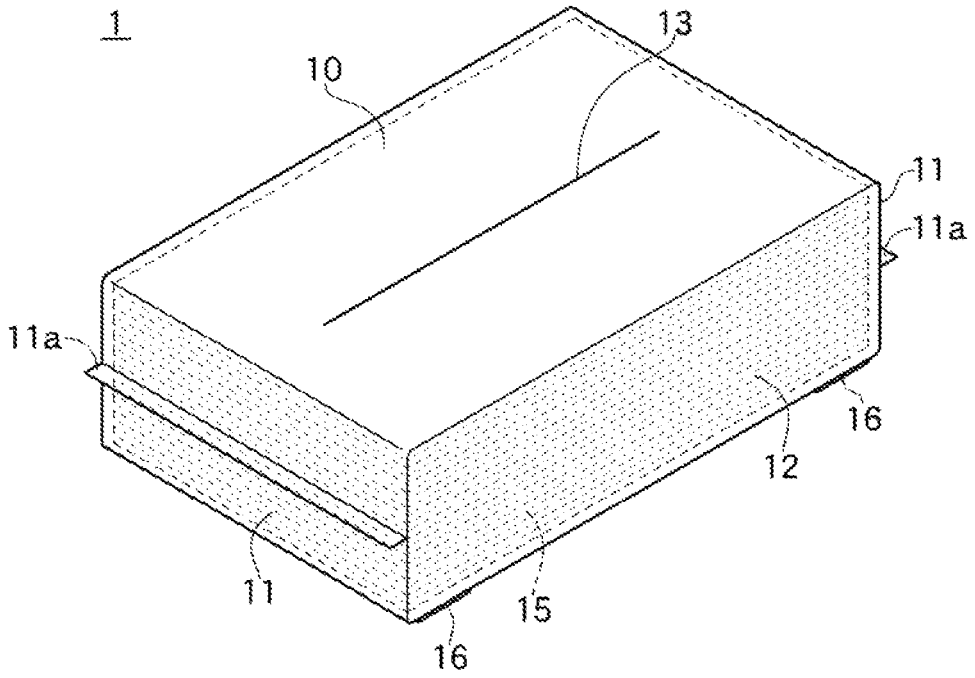
FIG. 1 is an explanatory diagram illustrating the configuration of a pillow package manufactured by an apparatus for manufacturing pillow packages according to a first embodiment of the present disclosure.

FIG. 1 is an explanatory diagram illustrating the configuration of a pillow package 1 manufactured by an apparatus for manufacturing pillow packages according to a first embodiment of the present disclosure. FIG. 1 is a perspective view of the pillow package 1 illustrating the appearance seen from diagonally above.

Figure 2:
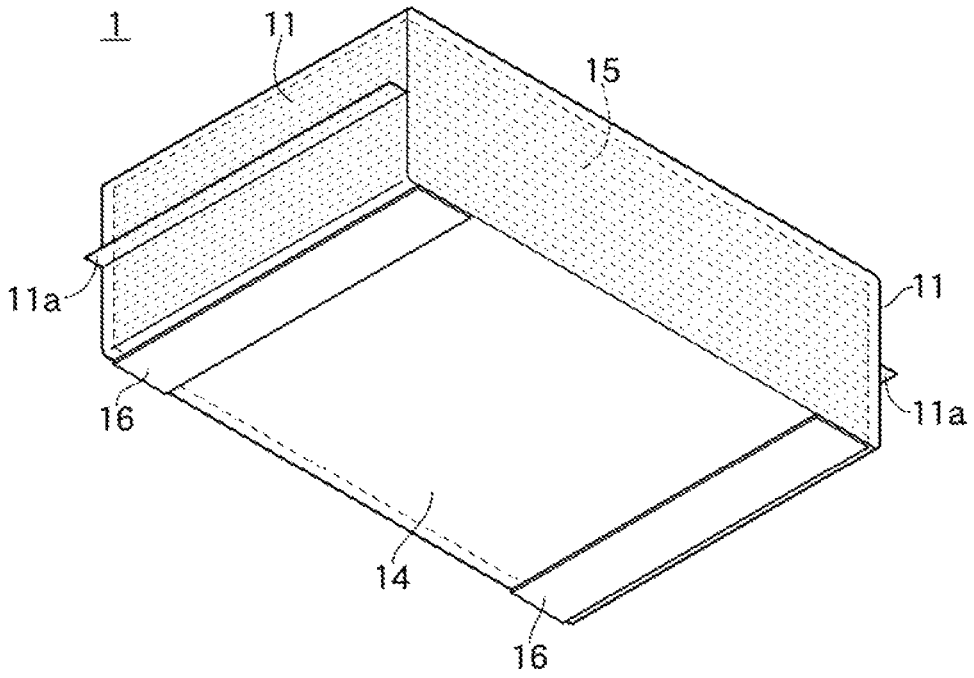
FIG. 2 is a perspective view of the pillow package in FIG. 1 illustrating the appearance seen from diagonally below.

FIG. 2 is a perspective view of the pillow package 1 in FIG. 1 illustrating the appearance seen from diagonally below.

In one example, the pillow package 1 is a package of a thin paper bundle 15, which is made by folding toilet paper that has been cut to a predetermined size and stacking and bundling hundreds of them, wrapped in a thin resin sheet, such as polyvinyl chloride.

The thin paper bundle 15 is, for example, a substantially rectangular parallelepiped. The pillow package 1 containing the thin paper bundle 15 has an upper surface 10 and a bottom 14 with a shape having long sides and short sides (substantially rectangular).

The pillow package 1 has a lateral side 11 between the short side of the upper surface 10 and the short side of the bottom 14 and has a longitudinal side 12 between the long side of the upper surface 10 and the long side of the bottom 14. The pillow package 1 has two opposing lateral sides 11 and two opposing longitudinal sides 12.

The lateral sides 11 each have a sealed portion 11*a* made by folding an open end of the thin resin sheet when wrapping the thin paper bundle 15 with a thin resin sheet, and sealing the end by heating. The sealed portion 11*a* extends along the short side of, for example, the upper surface 10 (bottom 14), that is, in the direction of the normal to the longitudinal side 12.

The pillow package 1 is provided with a cut portion 13 extending along the length of, for example, the pillow package 1 or the upper surface 10, in the center of the upper surface 10, so that the thin paper can be drawn from the contained thin paper bundle 15 (to the outside of the pillow package 1) one by one.

The pillow package 1 has double-sided tapes 16 bonded to the bottom 14 located on the back with respect to the cut portion 13. One surface of each double-sided tape 16 bonded to the bottom 14 (the surface not in contact with the bottom 14) is covered with a protective sheet or the like.

The double-sided tapes 16 are individually bonded to the vicinity of the individual two short sides of the bottom 14 of the pillow package 1 illustrated in FIG. 1 and FIG. 2. The number of double-sided tapes 16 bonded to the pillow package 1, the position to which the double-sided tape 16 is bonded at the bottom 14, and so on are not limited to those described here.

The bottom 14 is provided with a joint portion (not shown) at which the ends of the resin sheet are superposed to form a substantially cylindrical shape when the thin paper bundle 15 is wrapped in the resin sheet, as described above, and the superposed portions are bonded by heating. The sealed portions 11*a* described above seal the openings formed at opposite ends of the resin sheet formed into the substantially cylindrical shape, for example.

Figure 3:
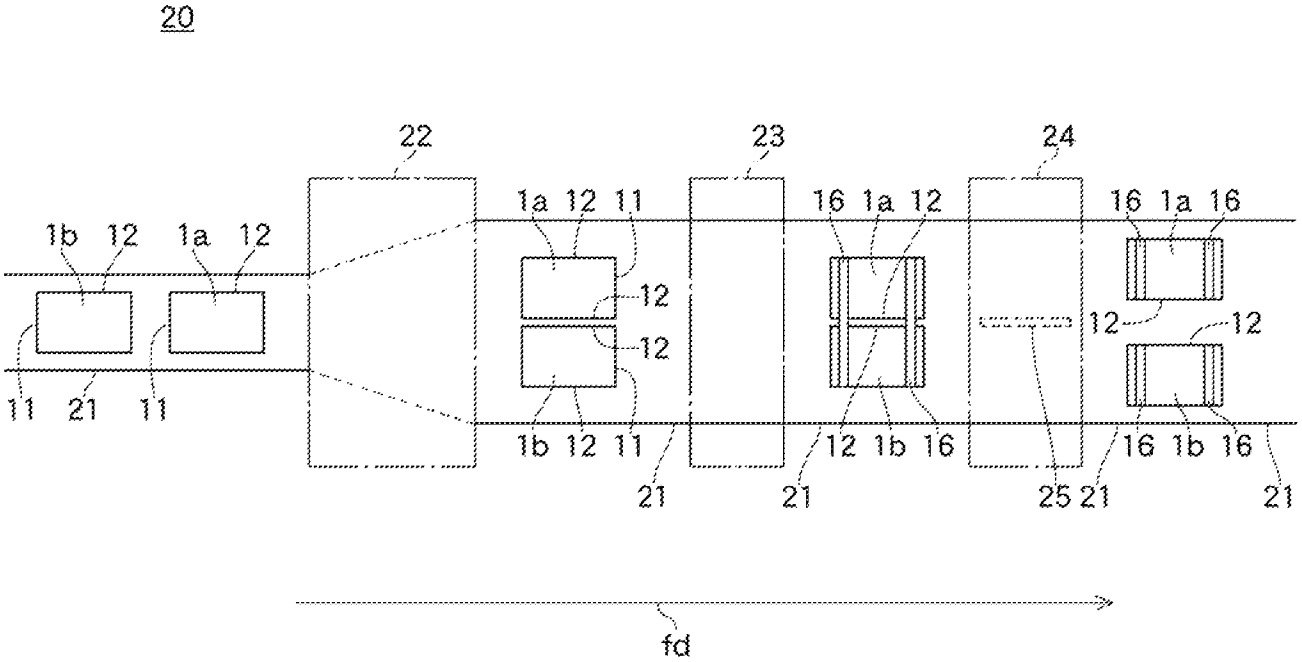
FIG. 3 is an explanatory diagram illustrating, in outline, the configuration of an apparatus for manufacturing pillow package according to the first embodiment.

FIG. 3 is an explanatory diagram illustrating, in outline, the configuration of an apparatus 20 for manufacturing pillow package according to the first embodiment.

FIG. 3 illustrates the arrangement of a section (manufacturing line), of the manufacturing apparatus 20, for bonding the double-sided tapes 16 to pillow packages 1 a and 1*b* seen from above.

The pillow packages 1*a* and 1*b* have the same configuration as that of the pillow package 1 shown in FIG. 1 and FIG. 2. In other words, the manufacturing apparatus 20 is configured to manufacture the pillow package 1 described above.

The manufacturing apparatus 20 includes a conveying section 21 for moving the pillow packages 1*a* and 1*b* in the direction indicated by, for example, arrow fd, that is, from left to right in the drawing.

Examples of the conveying section 21 include a belt conveyor and a partial combination of a belt conveyor and a roller conveyer. The manufacturing apparatus 20 illustrated in FIG. 3 is a section that conveys the pillow packages 1*a* and 1*b*, in which the thin paper bundle 15 is subjected to pillow packaging, to positions where a placement changing section 22, a tape bonding section 23, and a tape cutting section 24 are disposed, in which the other sections are not illustrated.

The manufacturing apparatus 20 is configured to wrap the thin paper bundle 15 in a thin resin sheet, for example, form the above-described joint portions, fold the open ends, and heat them to form the sealed portions 11*a* to thereby manufacture the pillow packages 1*a* and 1*b* in sequence at sections not shown (upstream from the conveying section 21) before conveying the pillow packages 1*a* and 1*b* to the placement changing section 22 using the conveying section 21.

The manufacturing apparatus 20 is configured to place the pillow packages 1*a* and 1*b* provided with the sealed portions 11*a* on the upper surface of the placement sections of the conveying section 21, with their respective sealed portions 11*a* opposed (arranged in line along the conveying direction).

The placement changing section 22 is configured to change the placement positions and placement directions of the pillow packages 1*a* and 1*b* placed on the conveying section 21.

Specifically, the placement changing section 22 has a mechanism for moving each of the pillow packages 1*a* and 1*b* in a predetermined direction, when the pillow packages 1*a* and 1*b* are placed on the upper surface of the conveying section 21, with their respective sealed portions 11*a* opposed (arranged in a line along the conveying direction), so that the longitudinal side 12 of the pillow package 1*a* and the longitudinal side 12 of the pillow package 1*b* are opposed to each other, that is, so as to arrange them in two rows along the conveying direction.

The placement changing section 22 is configured, in arranging the pillow package 1*a* and the pillow package 1*b*, as described above, to arrange them close to each other so as to form a slight gap between the longitudinal side 12 of the pillow package 1*a* and the longitudinal side 12 of the pillow package 1*b* (a gap that allows a cutting blade 25 described later to enter).

When the pillow package 1*a* and the pillow package 1*b* are arranged, for example, in two rows by the placement changing section 22, as described above, the pillow package 1*a* and the pillow package 1*b* are placed on the conveying section 21, with their posture adjusted, so that the bottoms 14 are disposed upside (the upper surface 10 comes into contact with the upper surface of the conveying section 21).

The tape bonding section 23 is configured to bond a string of double-sided tape 16 to each of the bottoms 14 of the pillow package 1*a* and the pillow package 1*b* disposed close to each other by the placement changing section 22.

Specifically, the tape bonding section 23 is configured to bond the double-sided tapes 16, in which only a protective sheet on one surface is peeled, to the bottoms 14 and the vicinity of the edges of the lateral sides 11 of the pillow package 1*a* and the pillow package 1*b*.

The tape bonding section 23 is configured to bond the double-sided tape 16 to each of the pillow packages 1*a* and 1*b* which are arranged close to each other (in two rows along the width of the conveying section 21), as described above. The double-sided tape 16 is cut into substantially the same length as the widthwise size of the pillow packages 1*a* and 1*b*, (the length between the outer longitudinal side 12 of the pillow package 1*a* and the outer longitudinal side 12 of the pillow package 1*b*, which are arranged with the longitudinal sides 12 opposed) and extends along the width of the conveying section 21.

The tape bonding section 23 illustrated here is configured to bond the double-sided tape 16 along the edge of the lateral side 11 of each of the pillow packages 1*a* and 1*b* at the bottom 14 of each of the pillow packages 1*a* and 1*b* (as shown in FIG. 2 and so on).

In other words, the tape bonding section 23 is configured to bond two double-sided tapes 16 to the individual pillow packages 1*a* and 1*b*.

The tape cutting section 24 includes a cutting blade 25 that cuts a string of double-sided tape 16 bonded to the pillow package 1*a* and the pillow package 1*b* and is configured to put the cutting blade 25 between the pillow package 1*a* and the pillow package 1*b* conveyed by the conveying section 21 to cut off the double-sided tape 16 located at this portion.

Figure 4:
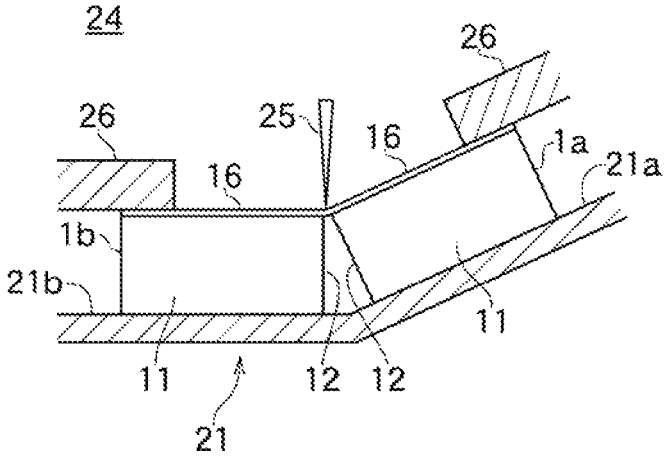
FIG. 4 is an explanatory diagram illustrating an example configuration of a tape cutting section and so on in FIG. 3.

FIG. 4 is an explanatory diagram illustrating an example configuration of the tape cutting section 24 and so on in FIG. 3. FIG. 4 shows a state in which the pillow packages 1*a* and 1*b* conveyed to the placement position of the tape cutting section 24 by the conveying section 21 in FIG. 3 are separated by the cutting blade 25, and illustrates, in outlie, the configuration of the conveying section 21 at the installation position of the tape cutting section 24, and the cutting blade 25, holders 26, and so on which are provided at the tape cutting section 24.

FIG. 4 illustrates the configurations of the tape cutting section 24, the conveying section 21 at the installation position of the tape cutting section 24, and so on when the lateral sides 11 of the pillow packages 1*a* and 1*b* (to which the double-sided tape 16 is bonded) placed on the conveying section 21 are seen from front.

The conveying section 21 is configured to have two placement sections, for example, a first placement section 21*a* (an inclined placement section) and a second placement section 21*b*, at the installation position of the tape cutting section 24.

Specifically, the conveying section 21 is configured such that, at the installation position of the tape cutting section 24, the upper surface of the second placement section 21*b* on which the pillow package 1*b* is placed is horizontal, and the upper surface of the first placement section 21*a* on which the pillow package 1*a* is placed is inclined upward from the boundary with the second placement section 21*b* toward an edge of the first placement section 21*a* (one end of the conveying section 21 orthogonal to the conveying direction).

In other words, the first placement section 21*a* has an inclined surface inclined along the width of the conveying section 21 so that an edge of the conveying section 21 in the width direction (in the direction orthogonal to the conveying direction) is higher than the upper surface of the second placement section 21*b* and is configured such that the pillow package 1*a* is placed on the inclined surface. The inclined surface of the first placement section 21*a* is inclined so that the space (gap) between the longitudinal side 12 of the pillow package 1*a* and the longitudinal side 12 of the adjacent pillow package 1*b* can be expanded, as will be described later.

The tape cutting section 24 is provided with the cutting blade 25 so that the cutting blade 25 comes into contact with the double-sided tape 16 bonded between the pillow package 1*a* and the pillow package 1*b*, for example, which are placed on the first placement section 21*a* and the second placement section 21*b*, respectively.

The cutting blade 25 is disposed so that the blade edge of the cutting blade 25 extends along the conveying direction of the pillow packages 1*a* and 1*b*.

The cutting blade 25 of the tape cutting section 24 illustrated here is disposed so that the edge comes into contact with the double-sided tape 16 bonded to the pillow packages 1*a* and 1*b*, from above. In another example, the cutting blade 25 disposed at a fixed height may be brought into contact with the double-sided tape 16 connecting the pillow packages 1*a* and 1*b* along the conveying direction of the conveying section 21. The configuration of the tape cutting section 24 of the manufacturing apparatus 20 is not limited to the configuration in which the cutting blade 25 is brought into contact with the double-sided tape 16 from above.

The tape cutting section 24 includes the holders 26 for holding down appropriate portions of the pillow packages 1*a* and 1*b*, for example, the vicinity of ends of the bottoms 14, from above so that, for example, when the cutting blade 25 comes into contact with the double-sided tape 16 from above the pillow packages 1*a* and 1*b*, part of the pillow packages 1*a* and 1*b* is not raised as a reaction.

Next, the operation will be described.

The manufacturing apparatus 20 wraps the thin paper bundle 15 in a thin resin sheet or the like, at the upstream sections (not illustrated in FIG. 3 and so on) from the conveying section 21, for example, forms the above-described joint portions, and forms the sealed portions 11*a* by heating the openings.

The pillow packages 1*a* and 1*b* in which the thin paper bundle 15 is sealed with the sealed portion 11*a* and so on are placed on the upper surface of the conveying section 21 in a line along the conveying direction (with the sealed portions 11*a* opposed) and are conveyed toward the placement changing section 22, as shown in FIG. 3.

The placement changing section 22 newly arranges the pillow packages 1*a* and 1*b* conveyed in a line, with the sealed portion 11*a* opposed, into two rows so that the longitudinal sides 12 of the pillow packages 1*a* and 1*b* are opposed. The orientation of the pillow packages 1*a* and 1*b* arranged in two rows are adjusted so that the longitudinal direction is parallel to the conveying direction of the conveying section 21 and that the sealed portions 11*a* of the pillow packages la and 1*b* are arranged along the width of the conveying section 21.

At that time, the pillow package 1*a* and the pillow package 1*b* are disposed close to each other, with a gap that allows the cutting blade 25 to enter between the opposing longitudinal sides 12.

The placement orientations of the pillow packages 1*a* and 1*b* are adjusted so that the bottoms 14 of the pillow packages 1*a* and 1*b* are turned up and the upper surfaces 10 come into contact with the placement sections of the conveying section 21.

When the pillow packages 1*a* and 1*b* placed in two rows on the upper surface of the conveying section 21 are conveyed, the tape bonding section 23 bonds the string of double-sided tape 16 to the pillow packages 1*a* and 1*b* disposed close to each other, as described above, along the width of the conveying section 21 (in the direction orthogonal to the conveying direction).

The pillow packages 1*a* and 1*b* to which the string of double-sided tape 16 is bonded are conveyed to the tape cutting section 24 by the conveying section 21.

For example, at the installation position of the tape cutting section 24, the pillow package 1*a* conveyed by the conveying section 21 is placed at the first placement section 21*a*, and likewise, the pillow package 1*b* conveyed by the conveying section 21 is placed at the second placement section 21*b*. At that time, the pillow packages 1*a* and 1*b* are connected by the double-sided tape 16 bonded to the individual bottoms 14.

Since the first placement section 21*a* is inclined so that the edge becomes high, as described above, the pillow package 1*a* placed at the first placement section 21*a* is inclined to open the space below the double-sided tape 16 connecting the pillow package 1*a* and the pillow package 1*b*, in other words, increase the gap between the opposing longitudinal side 12 of the pillow package 1*a* and the opposing longitudinal side 12 of the pillow package 1*b*.

When the opposing longitudinal sides 12 of the pillow package 1*a* and the pillow package 1*b* are spaced apart, the tape cutting section 24 moves the cutting blade 25 downward from above into contact with the double-sided tape 16 connecting the pillow package 1*a* and the pillow package 1*b* to cut the portion.

In moving the cutting blade 25 downward to cut the double-sided tape 16, the conveying operation of the conveying section 21 and the like is stopped to fix the positions of the pillow packages 1*a* and 1*b* and so on. If the double-sided tape 16 can easily be cut by bringing the cutting blade 25 into contact therewith, the cutting blade 25 may be brought into contact with the double-sided tape 16 while the conveying operation of the conveying section 21 and the like is being performed.

In cutting the double-sided tape 16 by bringing the cutting blade 25 into contact therewith, placing the pillow package 1*a* on the inclined first placement section 21*a* to incline the pillow package 1*a* increases the gap between the pillow package 1*a* and the pillow package 1*b*, thereby preventing the cutting blade 25 from coming into contact with the resin sheet serving as the outer covering of each of the pillow packages 1*a* and 1*b*. In other words, this can prevent damage to the pillow packages 1*a* and 1*b*.

The manufacturing apparatus 20 in FIG. 3 can include sections with the following configurations in place of the tape cutting section 24 and the conveying section 21, and so on shown in FIG. 4.

Figure 5:
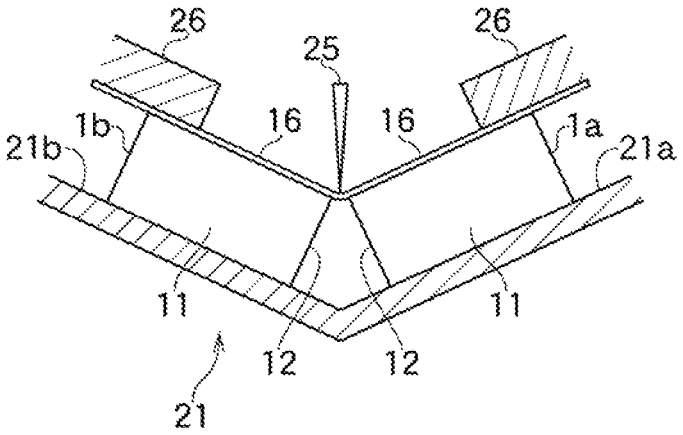
FIG. 5 is an explanatory diagram illustrating another configuration of the tape cutting section and so on in FIG. 3.

FIG. 5 is an explanatory diagram illustrating another configuration of the tape cutting section 24 and so on in FIG. 3. FIG. 5 illustrates the components of the tape cutting section 24, the configuration of the conveying section 21 at the installation position of the tape cutting section 24, and so on when the lateral sides 11 of the pillow packages 1*a* and 1*b* placed on the conveying section 21 (after the double-sided tape 16 is bonded) in front view, as in FIG. 4.

The conveying section 21 in FIG. 5 is configured such that a second placement section 21*b* (a second inclined placement section) on which the pillow package 1*b* is placed has an inclined surface inclined in a direction different from that of a first placement section 1*a* (a first inclined placement section), and the other is the same as those of the sections shown in FIG. 4.

In other words, the conveying section 21 in FIG. 5 includes the following second placement section 21*b* at the installation position of the tape cutting section 24. This second placement section 21*b* has an inclined surface inclined upward toward an edge of the second placement section 21*b* (another widthwise end of the conveying section 21) from the boundary with the first placement section 21*a* and is configured such that the pillow package 1*b* is placed on the inclined surface.

The conveying section 21 in FIG. 5 further includes the first placement section 21*a* at the installation position of the tape cutting section 24. This first placement section 21*a* has an inclined surface inclined upward from the boundary with the second placement section 21*b* toward an edge of the first placement section 21*a* (one widthwise end of the conveying section 21) and is configured such that the pillow package 1*a* is placed on the inclined surface.

The direction of inclination of the inclined surface of the first placement section 21*a* and the direction of inclination of the inclined surface of the second placement section 21*b* allows the space (gap) between the longitudinal side 12 of the pillow package 1*a* and the longitudinal side 12 of the adjacent pillow package 1*b* to be increased (as described above).

The conveying section 21 in FIG. 5 is configured such that the opposite widthwise edges of the conveying section 21 are inclined in different directions along the width of the conveying section 21 so as to be higher than the boundary between the first placement section 21*a* and the second placement section 21*b* at the installation position of the tape cutting section 24.

In other words, the surface (upper surface) of the conveying section 21 shown in FIG. 5 is recessed at the boundary between the first placement section 21*a* and the second placement section 21*b* into a substantially V-shape along the width of the conveying section 21.

The tape cutting section 24 in FIG. 5 includes holders 26 for holding down appropriate portions of the pillow packages 1*a* and 1*b* placed on the first placement section 21*a* and the second placement section 21*b*, respectively, for example, the vicinity of ends of the bottoms 14, from above. The holders 26 are disposed in correspondence with the conveying section 21 in which the boundary between the first placement section 21*a* and the second placement section 21*b* is recessed.

For example, when the pillow package 1*a* is placed on the first placement section 21*a*, and the pillow package 1*b* is placed on the second placement section 21*b* in FIG. 5, the space under the double-sided tape 16 connecting the pillow package 1*a* and the pillow package 1*b* is opened to separate the opposing longitudinal sides 12 of the pillow packages 1*a* and 1*b* (increase the gap between the longitudinal sides 12 of the pillow packages 1*a* and 1*b*).

This reliably prevents the cutting blade 25 from coming into contact with either of the longitudinal sides 12 or the like when cutting the double-sided tape 16 connecting the pillow package 1*a* and the pillow package 1*b*, thereby preventing damage to the pillow packages 1*a* and 1*b*.

Second Embodiment

Figure 6:
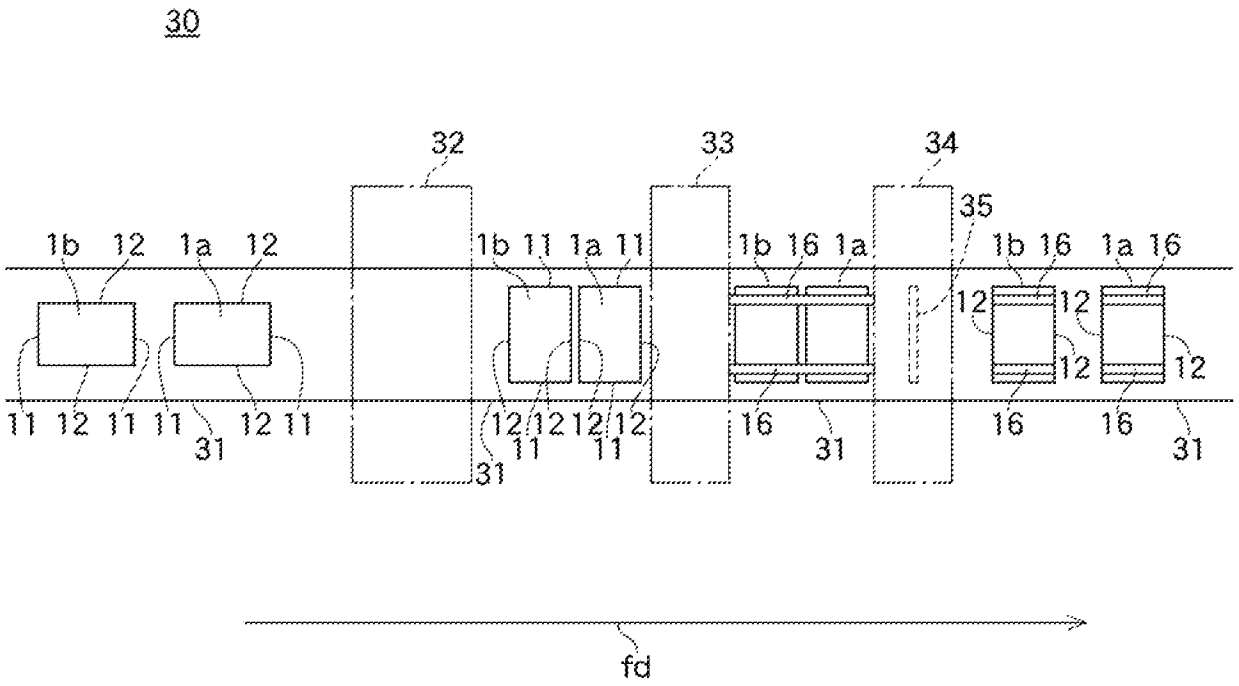
FIG. 6 is an explanatory diagram illustrating, in outline, the configuration of an apparatus for manufacturing pillow packages according to a second embodiment.

FIG. 6 is an explanatory diagram illustrating, in outline, the configuration of an apparatus 30 for manufacturing pillow packages according to a second embodiment.

FIG. 6 illustrates the arrangement of a section (manufacturing line), of the manufacturing apparatus 30, for bonding the double-sided tapes 16 to pillow packages 1*a* and 1*b* seen from above.

The pillow packages 1*a* and 1*b* have the same configuration as that of the pillow package 1 shown in FIG. 1 and FIG. 2. The manufacturing apparatus 30 is configured to manufacture the pillow package 1 described above.

The manufacturing apparatus 30 includes a conveying section 31 for moving the pillow packages 1*a* and 1*b* in the direction indicated by, for example, arrow fd, that is, from left to right in the drawing.

Examples of the conveying section 31 include a belt conveyor, a roller conveyor, and a partial combination of a belt conveyor and a roller conveyer. The manufacturing apparatus 30 illustrated in FIG. 6 is a section that conveys the pillow packages 1*a* and 1*b*, in which the thin paper bundle 15 is subjected to pillow packaging, to positions where a placement changing section 32, a tape bonding section 33, and a tape cutting section 34 are disposed, in which the other sections are not illustrated.

The manufacturing apparatus 30 is configured to wrap the thin paper bundle 15 in a thin resin sheet, for example, form the above-described joint portions, fold the open ends, and heat them to form the sealed portions 11*a* to thereby manufacture the pillow packages 1*a* and 1*b* in sequence at sections not shown (upstream from the conveying section 31) before conveying the pillow packages 1*a* and 1*b* to the placement changing section 32 using the conveying section 31.

The manufacturing apparatus 30 is configured to place the pillow packages 1*a* and 1*b* provided with the sealed portions 11*a* on the upper surface of the placement sections of the conveying section 31, with their respective sealed portions 11*a* opposed (arranged in line along the conveying direction).

The placement changing section 32 is configured to change the placement directions and so on of the pillow packages 1*a* and 1*b* placed on the conveying section 31.

Specifically, the placement changing section 32 has a mechanism for rotating the individual pillow packages 1*a* and 1*b*, when the pillow packages 1*a* and 1*b* are placed on the upper surface of the conveying section 31, with their respective sealed portions 11*a* opposed (arranged in a line along the conveying direction), so that the longitudinal side 12 of the pillow package 1*a* and the longitudinal side 12 of the pillow package 1*b* are opposed to each other, and the sealed portions 11*a* of the pillow packages 1*a* and 1*b* are arranged at the edges of the conveying section 31 in the width direction (the direction orthogonal to the conveying direction).

The placement changing section 32 is configured, in arranging the pillow package 1*a* and the pillow package 1*b*, as described above, to arrange them close to each other so as to form a slight gap between the longitudinal side 12 of the pillow package 1*a* and the longitudinal side 12 of the pillow package 1*b* (a gap that allows a cutting blade 35 described later to enter). When the sealed portions 11*a* are arranged, for example, at the widthwise edges of the conveying section 31 by the placement changing section 32, as described above, the pillow package 1*a* and the pillow package 1*b* are placed on the conveying section 31, with their posture adjusted, so that the bottoms 14 are disposed upside (the upper surface 10 comes into contact with the upper surface of the conveying section 31).

The tape bonding section 33 is configured to bond a string of double-sided tape 16 to each of the bottoms 14 of the pillow package 1*a* and the pillow package 1*b* disposed close to each other by the placement changing section 32.

Specifically, the tape bonding section 33 is configured to bond the double-sided tapes 16, in which only a protective sheet on one surface is peeled, to the vicinity of the edges which are the boundary between the bottoms 14 and the lateral sides 11 of the pillow package 1*a* and the pillow package 1*b*. The tape bonding section 33 is configured to bond the double-sided tape 16 to the pillow packages 1*a* and 1*b* along the conveying direction of the conveying section 31 so as to connect them. In other words, the tape bonding section 33 is configured to bond the double-sided tape 16 continuously so as to connect the pillow package 1*a* and the pillow package 1*b* conveyed in sequence by the conveying section 31.

The tape bonding section 33 illustrated here is configured to bond the double-sided tape 16 along the edge of the lateral side 11 of each of the pillow packages 1*a* and 1*b* at the bottom 14 of each of the pillow packages 1*a* and 1*b* (as shown in FIG. 2 and so on). In other words, the tape bonding section 33 is configured to bond two double-sided tapes 16 to the individual pillow packages 1*a* and 1*b*.

The tape cutting section 34 includes the cutting blade 35 that cuts a string of double-sided tape 16 bonded to the pillow package 1*a* and the pillow package 1*b* and is configured to put the cutting blade 35 between the pillow package 1*a* and the pillow package 1*b* conveyed by the conveying section 31 to cut off the double-sided tape 16 located at this portion.

Figure 7:
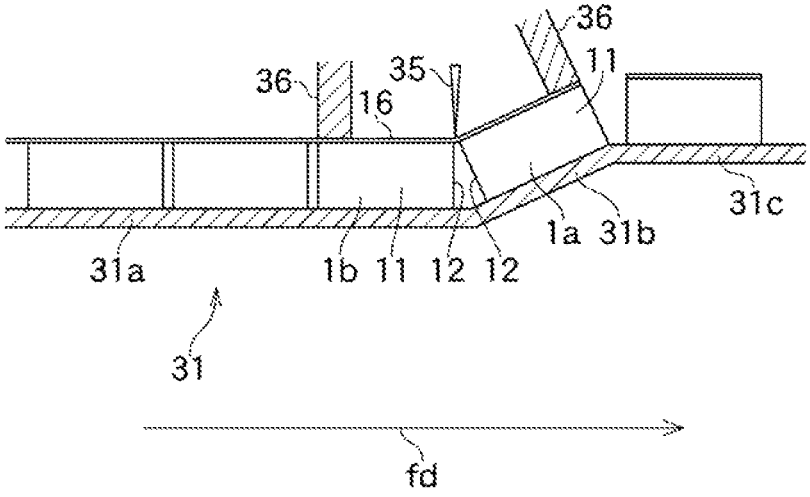
FIG. 7 is an explanatory diagram illustrating an example configuration of a tape cutting section and so on in FIG. 6.

FIG. 7 is an explanatory diagram illustrating an example configuration of the tape cutting section 34 and so on in FIG. 6. FIG. 7 shows a state in which the pillow packages 1*a* and 1*b* conveyed to the placement position of the tape cutting section 34 by the conveying section 31 in FIG. 6 are separated by the cutting blade 35, and illustrates, in outlie, the configuration of the conveying section 31 at the installation position of the tape cutting section 34, and the cutting blade 35, holders 36, and so on which are provided at the tape cutting section 34.

FIG. 7 illustrates the configurations of the tape cutting section 34, the conveying section 31 at the installation position of the tape cutting section 34, and so on when the longitudinal sides 12 of the pillow packages 1*a* and 1*b* (to which the double-sided tape 16 is bonded) placed on the conveying section 31 are seen from front (or seen from a side of the manufacturing apparatus 30 or the conveying section 31).

The conveying section 31 includes, at the installation position of the tape cutting section 34, a horizontal conveying section 31*a* that conveys the placed pillow packages 1*a* and 1*b* horizontally, an inclined placement section 31*b* that inclines, for example, the pillow package 1*a* located at the distal end (head) in the conveying direction indicated by arrow fd, of the pillow packages 1*a* and 1*b* connected by the string of double-sided tape 16, and a horizontal conveying section 31*c* that moves the pillow packages 1*a* and 1*b*, for example, on which the double-sided tape 16 is cut by the cutting blade 35 horizontally.

The inclined placement section 31*b* has an inclined surface that inclines upward from the boundary between the inclined placement section 31*b* and the horizontal conveying section 31*a* toward the boundary between the inclined placement section 31*b* and the horizontal conveying section 31*c* and is configured such that the pillow package 1*a* or the like is placed on the inclined surface. The inclined surface of the inclined placement section 31*b* is inclined so that the space (gap) between the longitudinal side 12 of the pillow package 1*a* and the longitudinal side 12 of the pillow package 1*b* can expanded, as will be described later.

The tape cutting section 34 is provided with the cutting blade 35 so that the cutting blade 35 comes into contact with the double-sided tape 16 bonded between, for example, the pillow package 1*a* located (placed) on the inclined placement section 31*b* and the pillow package 1*b* located on the horizontal conveying section 31*a*.

The cutting blade 35 is disposed so that the blade edge of the cutting blade 35 extends so as to cross at right angles to the conveying direction of the pillow packages 1*a* and 1*b* and moves downward from above the double-sided tape 16 bonded to the pillow packages 1*a* and 1*b* into contact therewith.

The tape cutting section 34 includes the holders 36 for holding down appropriate portions of the pillow packages 1*a* and 1*b*, for example, the vicinity of ends of the bottoms 14, from above so that, when the cutting blade 35 comes into contact with the double-sided tape 16 from above the pillow package 1*a* and the pillow package 1*b* connected to the pillow package 1*a*, part of the pillow packages 1*a* and 1*b* is not raised as a reaction.

Next, the operation will be described.

The manufacturing apparatus 30 wraps the thin paper bundle 15 in a thin resin sheet or the like, for example, forms the above-described joint portions, and forms the sealed portions 11*a* by heating the openings at the upstream sections (not illustrated in FIG. 6 and so on) from the conveying section 31.

The pillow packages 1*a* and 1*b* in which the thin paper bundle 15 is sealed with the sealed portion 11*a* and so on are placed on the upper surface of the conveying section 31 in a line along the conveying direction and are conveyed toward the placement changing section 32, as shown in FIG. 6.

The placement changing section 32 newly arranges the pillow packages 1*a* and 1*b* conveyed in a line, with the sealed portion 11*a* opposed, so that the longitudinal sides 12 of the pillow packages 1*a* and 1*b* are opposed and cross at right angles to the conveying direction. In other words, the placement changing section 32 changes the orientations (of the placement) of the pillow packages 1*a* and 1*b* so that the sealed portions 11*a* of the pillow packages 1*a* and 1*b* are arranged along the widthwise ends of the conveying section 31.

At that time, the pillow package 1*a* and the pillow package 1*b* are disposed close to each other, with a gap that allows the cutting blade 35 to enter provided between the opposing longitudinal sides 12.

The placement orientations of the pillow packages 1*a* and 1*b* are adjusted so that the bottoms 14 of the pillow packages 1*a* and 1*b* are turned up and the upper surfaces 10 come into contact with the placement sections of the conveying section 31.

When the pillow packages 1*a* and 1*b* placed in a line on the placement sections of the conveying section 31 are conveyed in sequence, the tape bonding section 33 bonds the string of double-sided tape 16 to the pillow packages 1*a* and 1*b* along the conveying direction of the conveying section 31.

The pillow packages 1*a* and 1*b* to which the string of double-sided tape 16 is bonded are conveyed to the tape cutting section 34 by the conveying section 31 (the horizontal conveying section 31*a*).

When a plurality of pillow packages connected by the double-sided tape 16, conveyed by the horizontal conveying section 31*a*, reaches the installation position of the tape cutting section 34, a pillow package at the head of the plurality of pillow packages connected by the double-sided tape 16, for example, the pillow package 1*a*, is placed on (runs on) the inclined placement section 31*b*.

The pillow package 1*a* placed on the inclined placement section 31 is inclined in such a manner that the longitudinal sides 12 disposed on the horizontal conveying section 31*c* are raised. In other words, the head of the double-sided tape 16 bonded to the bottom 14 of the pillow package 1*a* is pushed upward.

At that time, the pillow package 1*b* next to the pillow package 1*a* is placed on the horizontal conveying section 31*a*, and the double-sided tape 16 bonded to the bottom 14 of the pillow package 1*b* is in horizontal position.

This expands the space between the upper surface 10 of the pillow package 1*a* (a portion in contact with the inclined placement section 31*b*) and the upper surface 10 of the pillow package 1*b* (a portion in contact with the horizontal conveying section 31*a*) which are not connected by the double-sided tape 16, thereby expanding the gap between the opposing longitudinal sides 12 of the pillow package 1*a* and the pillow package 1*b*.

When the opposing longitudinal sides 12 of the pillow package 1*a* and the pillow package 1*b* are spaced apart, as described above, the tape cutting section 34 moves the cutting blade 35 downward from above into contact with the double-sided tape 16 connecting the pillow package 1*a* and pillow package 1*b*, thereby cutting the portion.

In moving the cutting blade 35 downward to cut the double-sided tape 16, the conveying operation of the conveying section 31 and so on is stopped, and the positions of the pillow packages 1*a* and 1*b* and so on connected by the double-sided tape 16 are fixed.

When the double-sided tape 16 connecting the pillow package 1*a* and the pillow package 1*b* is cut, for example, the cutting blade 35 is retracted upward, and the conveying section 31 starts the conveying operation to move the pillow packages in the conveying direction. At that time, the pillow package 1*a* of which the double-sided tape 16 is cut is pushed out from the inclined placement section 31*b* to the horizontal conveying section 31*c*, and the pillow package 1*b* is newly placed on the inclined placement section 31*b*, and the double-sided tape 16 bonded to the bottom 14 is cut, similarly to the pillow package 1*a*.

The pillow package 1*a* pushed to (placed on) the horizontal conveying section 31*c* is conveyed to a packaging section (not shown), for example, where a packaging process for grouping a predetermined number of pillow packages into a package for shipment is performed.

Thus, the tape bonding section 33 bonds the double-sided tape 16 to the pillow packages 1*a* and 1*b* conveyed by the conveying section 31 along the conveying direction. This allows the double-sided tape 16 drawn from a roll to be continuously bonded to the pillow packages 1*a* and 1*b* conveyed in sequence, simplifying the manufacturing process.

Thus, according to the first and second embodiments, placing one pillow package on the placement section having an inclined surface expands the space between it and another adjacent pillow package. This prevents the cutting blade from coming into contact with the outer coating of the pillow packages when cutting the double-sided tape connecting the one pillow package and the other pillow package, thereby preventing damage to the outer coatings.

Since a string of double-sided tape is bonded to the plurality of pillow packages, and then the double-sided tape connecting the pillow packages is cut, the manufacturing time can be reduced as compared with a case where the individual pillow packages are positioned, and then the double-sided tape is bonded.

REFERENCE SIGNS LIST

1 pillow package
10 upper surface
11 lateral side (short side)
11*a* sealed portion
12 longitudinal side
13 cut portion
14 bottom
15 thin paper bundle
16 double-sided tape
20, 30 manufacturing apparatus
21, 31 conveying section
21*a* first placement section
21*b* second placement section
22, 32 placement changing section
23, 33 tape bonding section
24, 34 tape cutting section
25, 35 cutting blade
26, 36 holder
31*a*, 31*c* horizontal conveying section
31*b* inclined placement section

The invention claimed is:

1. A method for manufacturing pillow packages, the method comprising:

a first process for wrapping a thin paper bundle of a plurality of sheets of thin paper with a resin sheet and sealing a predetermined portion of the resin sheet to form a sealed portion;

a second process for placing the pillow packages having the sealed portion on a conveying means;

a third process for changing orientation of the plurality of the pillow packages conveyed by the conveying means to predetermined placement orientation;

a fourth process for bonding a string of double-sided tape to predetermined surfaces of the plurality of pillow packages disposed upside at the predetermined placement orientation;

a fifth process for cutting the string of double-sided tape bonded to the plurality of pillow packages between the plurality of pillow packages;

wherein the fifth process places one pillow package of the plurality of pillow packages conveyed by the conveying means on an inclined placement section provided at the conveying means to incline the pillow package in a predetermined direction, a sixth process for expanding a space between another pillow package next to the one pillow package and the one pillow package; and a seventh process for bringing a cutting blade into contact with the string of double-sided tape bonded between the one pillow package and the other pillow package to cut the double-sided tape.

2. The method for manufacturing pillow packages according to claim 1, wherein the third process includes arranging the plurality of pillow packages in two rows along a width direction orthogonal to a conveying direction of the conveying means, the fourth process includes bonding the string of double-sided tape to the plurality of pillow packages arranged in two rows, and the sixth process includes placing the one pillow package aligned with the other pillow package in the width direction on the inclined placement section.

3. The method for manufacturing pillow packages according to claim 1, wherein the third process includes arranging the plurality of pillow packages in two rows along a width direction orthogonal to a conveying direction of the conveying means, the fourth process includes bonding the string of double-sided tape to the plurality of pillow packages arranged in two rows, the sixth process includes, wherein the inclined placement section includes a first inclined placement section and a second inclined placement section each having an inclined surface inclined in a different direction, placing the one pillow package arranged in the width direction together with the other pillow package on the inclined surface of the first inclined placement section to incline the one pillow package in one direction, and placing the other pillow package on the inclined surface of the second inclined placement section to incline the other pillow package in another direction.

4. The method for manufacturing pillow packages according to claim 1, wherein the third process includes arranging the plurality of pillow packages in such a manner that surfaces not including the sealed portion face each other, the fourth process includes bonding the string of double-sided tape in a conveying direction of the conveying means, to the plurality of pillow packages arranged in such a manner that the surfaces not including the sealed portion face each other, and the sixth process includes placing the one pillow package to which the string of double-sided tape is bonded and located at a head when conveyed by the conveying means on the inclined placement section.

5. An apparatus for manufacturing pillow packages, the apparatus comprising:

a conveying section that conveys pillow packages in which a thin paper bundle is wrapped with a resin sheet;

a placement changing section that changes orientation of the pillow packages placed on the conveying section to predetermined placement orientation;

a tape bonding section that bonds a string of double-sided tape to predetermined surfaces of the plurality of pillow packages, the surfaces being disposed upside at the predetermined placement orientation; and a tape cutting section that cuts the string of double-sided tape bonded to the plurality of pillow packages between the plurality of pillow packages, wherein the conveying section includes an inclined placement section that, when one pillow package of the plurality of pillow packages conveyed is placed, inclines the one pillow package in a predetermined direction to expand a gap between the one pillow package and another adjacent pillow package at the installation position of the tape cutting section, and wherein the tape cutting section includes a cutting blade that is brought into contact with the string of double-sided tape bonded between the one pillow package and the other pillow package placed on the inclined placement section.

* * * * *